US010009960B2

(12) United States Patent
Artal Lahoz et al.

(10) Patent No.: US 10,009,960 B2
(45) Date of Patent: Jun. 26, 2018

(54) COOKTOP HAVING A DETECTION ASSEMBLY AND METHOD FOR OPERATING A COOKTOP

(75) Inventors: Maria Carmen Artal Lahoz, Saragossa (ES); Jose-Ramon Garcia Jimenez, Saragossa (ES); Ignacio Garde Aranda, Saragossa (ES); Oscar Lucia Gil, Saragossa (ES); Ignacio Millan Serrano, Saragossa (ES); Daniel Palacios Tomas, Saragossa (ES); Ramon Peinado Adiego, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 700 days.

(21) Appl. No.: 13/262,275

(22) PCT Filed: Mar. 25, 2010

(86) PCT No.: PCT/EP2010/053935

§ 371 (c)(1),
(2), (4) Date: Sep. 30, 2011

(87) PCT Pub. No.: WO2010/118943

PCT Pub. Date: Oct. 21, 2010

(65) Prior Publication Data

US 2012/0024835 A1 Feb. 2, 2012

(30) Foreign Application Priority Data

Apr. 17, 2009 (ES) ..... 200930070

(51) Int. Cl.
*H05B 6/08* (2006.01)
*H05B 6/12* (2006.01)
(Continued)

(52) U.S. Cl.
CPC ..... *H05B 6/065* (2013.01); *H05B 2213/03* (2013.01); *H05B 2213/05* (2013.01)

(58) Field of Classification Search
CPC ..... H05B 6/065; H05B 2213/03; H05B 2213/05; H05B 6/08; H05B 6/12; H05B 6/04; H05B 6/06; H05B 2213/07
(Continued)

(56) References Cited

U.S. PATENT DOCUMENTS

| | | | | |
|---|---|---|---|---|
| 6,259,069 | B1 * | 7/2001 | Schotten et al. | 219/447.1 |
| 6,930,287 | B2 * | 8/2005 | Gerola et al. | 219/447.1 |
| 2007/0164017 | A1 * | 7/2007 | Gouardo et al. | 219/626 |

FOREIGN PATENT DOCUMENTS

| | | | |
|---|---|---|---|
| EP | 2034799 | A1 | 3/2009 |
| WO | 2005069688 | A2 | 7/2005 |
| WO | 2009016124 | A1 | 2/2009 |

OTHER PUBLICATIONS

International Search Report PCT/EP2010/053935.
National Search Report ES P200930070.

* cited by examiner

*Primary Examiner* — Michael Hoang
(74) *Attorney, Agent, or Firm* — Michael E. Tschupp; Andre Pallapies; Brandon G. Braun

(57) ABSTRACT

A cooktop includes a plurality of heating elements, a user interface for inputting a power level, a detection assembly for detecting a position and size of at least one cookware element, and a control unit designed to combine a plurality of heating elements into a heating zone depending on the detected size and position of the cookware element and to operate the heating elements of the heating zone with a total heat output. In order to ensure a reproducible total heat output, the control unit is designed to calculate a bottom surface of the cookware element from the measurands of the
(Continued)

0%
0%
0% detection assembly and to determine the total heat output depending on power level and bottom surface.

16 Claims, 3 Drawing Sheets

(51) Int. Cl.
*H05B 6/04* (2006.01)
*H05B 6/06* (2006.01)
(58) Field of Classification Search
USPC ..... 219/671, 626, 625, 660–667, 647, 650, 219/655–656
See application file for complete search history.

COOKTOP HAVING A DETECTION ASSEMBLY AND METHOD FOR OPERATING A COOKTOP

BACKGROUND OF THE INVENTION

The invention relates to a cooktop having a plurality of heating elements and a detection assembly for detecting a position and size of at least one cookware element and a method for operating a cooktop.

Cooktops having a plurality of heating elements are known from the prior art, said cooktops being embodied similarly and arranged in particular in a grid or in a matrix. Generic cooktops include a detection assembly, which detects cookware elements placed on the cooktop. A control unit of the cooktop evaluates the measuring results of the detection assembly and combines groups of heating elements, which are arranged in the region of a detected cookware element, into largely freely definable heating zones. The size and shape of the heating zones is therefore flexibly adjusted to the position of the cookware element, which is freely selected by the user, and to the size of the cookware element, whereas in conventional cooktops with unchangeable heating zones, the heating zone is selected as a function of the size of the cookware element. In such matrix cooktops having a plurality of heating elements and freely definable heating zones, a control unit operates the heating elements combined into a heating zone with a heat output, which is determined as a function of a power level set by way of the user interface. If the user sets the highest power level, the heating elements of a heating zone are each operated with the maximum heat output, while with lower power levels, the heating elements are operated with a predetermined fraction of the maximum heat output.

WO 2005/064992 A1 discloses an induction cooktop for instance, in which the total heat output of a heating zone is simulated by the power level selected by the user. The distribution of the total heat output onto the individual inductors complies with the degree of coverage of the inductors by the base of the cooking pot to be heated. Since the sum of the degrees of coverage of the inductors of a heating zone also depends on the position of the cooking pot, this method also does not result in a completely location-independent surface heat output. The calculation and regulation of the heat outputs is also very complicated, since in some circumstances, each of the inductors has to be operated with a different heat output. The different heat outputs may easily result in problems with flickers or intermodulation distortion.

The total heat output of a heating zone, in other words the sum of the heat outputs of the individual heating elements, is therefore dependent on the number of heating elements combined into the heating zone, when the power level selected by the user is the same. The heating elements are then generally assigned to a heating zone, which is adjusted to a specific pot if a degree of coverage between the base of this pot and the relevant heating element exceeds a predetermined minimum degree of coverage. The number of heating elements combined into a heating zone is therefore dependent on a position of the pot. For instance, the same pot can also cover three heating elements in a first position and four heating elements for more than the predetermined fraction in a second position. The unsatisfactory result ensues therefrom for the user in that the same pot is heated with different total heat outputs in different positions on the cooktop when the power level is set the same.

BRIEF SUMMARY OF THE INVENTION

The object underlying the invention is therefore in particular to provide a generic cooktop having a plurality of heating elements and a detection assembly to detect a position and size of at least one cookware element, the control unit of which can determine a total heat output of a heating zone at least largely independently of a position of the cookware element on the cooktop. The invention also relates to a method for operating a cooktop, according to which the total heat output can be determined independently of the position of a cookware element on the cooktop.

The invention is based in particular on a cooktop having a plurality of heating elements, a user interface for inputting a power level, a detection assembly for detecting a position and size of at least one cookware element and a control unit. The control unit is configured so as to combine a number of heating elements into a heating zone as a function of the detected position and size of the cookware element. The control unit also determines a total heat output of the heating zone as a function of the power level input by way of the user interface and operates the heating elements in accordance with the total heat output determined in that way.

It is proposed that the control unit be designed so as to calculate a bottom surface of the cookware element from the measurands of the detection assembly and to determine the total heat output as a function of the bottom surface. While known cooktops at best determine the number of heating elements, which are not in reversibly unique relationship with the bottom surface of the cooktop element and determine the total heat output implicitly as a function of the number of heating elements, the invention also attempts to avoid the afore-cited problems, which prevent direct dependency of the total heat output on the number of heating elements. The bottom surface of the cookware element is determined in particular with a higher accuracy than was possible by solely counting heating elements which are wholly or partially covered by the base of the cookware element. The control unit can also be designed such that it can determine the bottom surface of the cookware element at least partially independently of a number of heating elements of a heating zone assigned to the cookware element. This partially independent determination of the bottom surface can take place in the simplest embodiment of the invention by accounting for a correction factor, whereas further embodiments of the invention use methods which are borrowed from the digital image processing and are described in further detail below.

The invention can be used in particular in induction cooktops, in which the heating elements are inductors. Since the inductors can be used simultaneously as sensors to detect the cookware element, savings can be made in additional sensors of the detection assembly.

The measurement typically takes place by means of the detection assembly at regular grid points so that the measurands of the detection arrangement are assigned in each instance to a measuring point on a cooktop surface, with the measuring points forming a measuring point grid. In a particularly advantageous embodiment of the invention, the control unit is designed so as to determine the bottom surface with the aid of the course of the measurands between these measuring points. Sensors, in particular inductive sensors, are typically unsharp in a certain way. If a maximum value of a measurand means for instance that the sensor is completely covered by the cookware base, and the measured value 0 means that no cookware base is found in a larger surrounding area of the sensor, a transition region at the edge of the cookware base is expediently produced, in which the measurands assume values between the maximum value and 0. The precise position of the edge can be determined with great precision in this transition region by means of a suitable image processing method.

The edges of the cookware element can be detected with high precision by methods borrowed from digital image processing. In a particularly advantageous embodiment of the invention, it is proposed that the control unit be designed so as to determine a combined surface of pixels in such a binary image, said pixels being covered by a bottom surface.

To facilitate a characterization of the cookware elements for instance as oval roasting tins or round pots and/or a distinction between two closely adjacent pots and a large oval roasting tin, it is also proposed that the control unit be designed so as to determine an edge image of the combined area of pixels, in order to determine the shape of the bottom surface and/or the number of cookware elements arranged in the combined area. In particular, it is herewith possible to clearly distinguish between a situation with two closely adjacent round pots and a situation with an oval roasting tin for instance.

The total heat output can be determined in a simple and reproducible fashion by multiplying the bottom surface determined in that way with a maximum surface heat output and with a factor which depends on the power level. The factor may describe in particular a percentage portion of the heat output generated by the individual heating elements on the maximum heat output. In a development of the invention, it is proposed that the surface heat output be a monotonic decreasing function of the bottom surface. As a result, a poorer coupling of the heating elements to the bases of smaller cookware elements can typically be compensated for on account of the geometric situation. In the case of smaller pots, the effective coupling of the heating elements into the cookware base is determined in particular by proportionally higher losses at the edge of the base and/or heating zone.

A further aspect of the invention relates to a method for operating a cooktop. The method includes three steps; detecting a position and size of at least one cookware element by means of a detection assembly, combining a number of heating elements to form a heating zone as a function of the detected size and position of the cookware element, determining a total heat output of the heating zone as a function of a set power level and operating the heating elements of the heating zone with the total heat output.

It is proposed that the method also includes calculating a bottom surface of a cookware element from measurands of the detection assembly, with the total heat output of the heating zone being determined as a function of the bottom surface.

Further advantages emerge from the following description of the drawings. Exemplary embodiments of the invention are shown in the drawings. The drawing, the description and the claims contain a combination of numerous features. The person skilled in the art will also expediently examine the features individually and combine them to form further meaningful combinations;

DETAILED DESCRIPTION OF EXEMPLARY EMBODIMENTS OF THE PRESENT INVENTION

Figure 1:
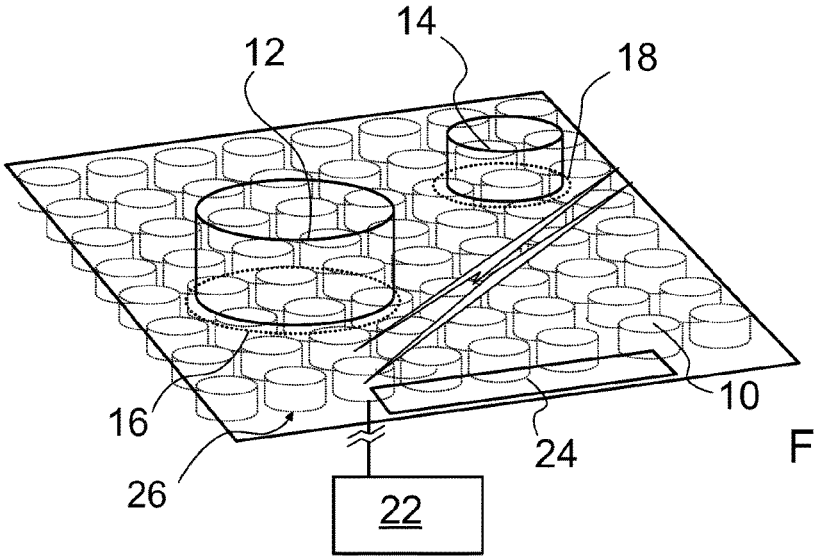
FIG. 1 shows a cooktop with a matrix of heating elements and two cooking pots placed thereupon.

FIG. 1 shows a schematic representation of a cooktop having a plurality of heating elements embodied as inductors 10, which are arranged in a grid. Two cooking pots 12, 14 are arranged on the cooktop, with the first cooking pot 12 in most instances covering five inductors 10, while the second cooking pot 14 has a small pot diameter and only completely covers one inductor 10. The inductors covered for the most part by the respective cooking pots 12, 14 each form a heating zone 16, 18 assigned to the corresponding cooking pot 12, 14.

A control unit 22 of the cooktop receives signals from a user interface 24, which also includes a display (not shown) and operates the inductors as a function of the settings performed by way of the user interface. In particular, a user can select a power level for each of the heating zones 16, 18 by way of the user interface 24. 16 to 18 different values for the power levels are typically available here to the user.

Figure 2:
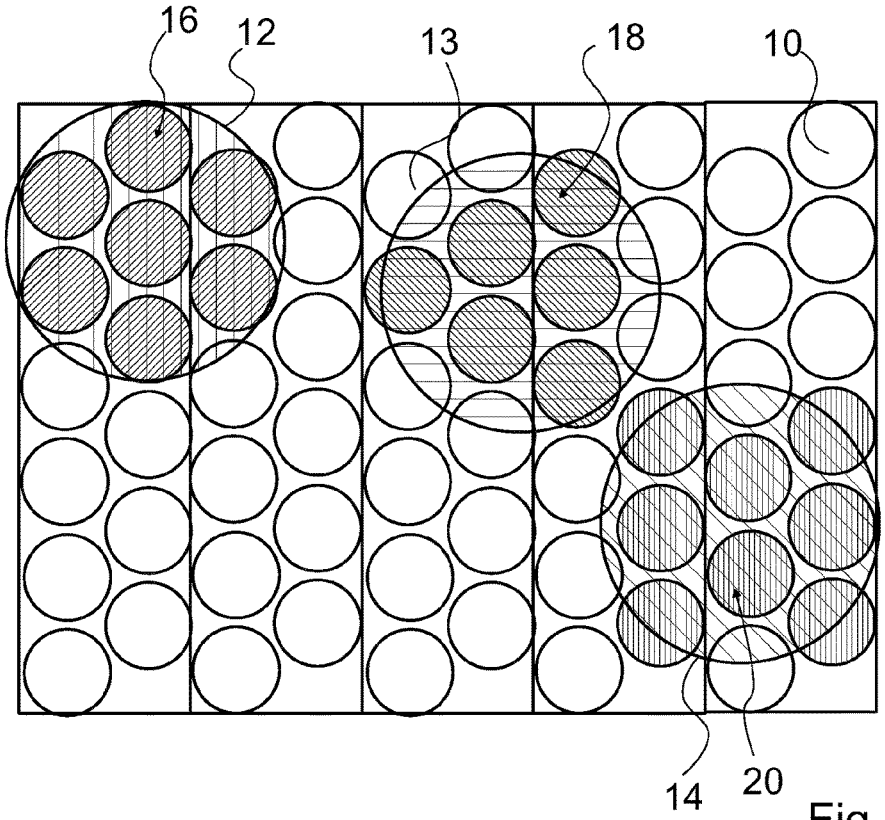
FIG. 2 shows a top view of a cooktop with three equally sized cooking pots in different positions, to which a heating zone is assigned in each instance.

FIG. 2 shows a cooktop with inductors 10, which are arranged in an oblique-angled grid. The grid has three axes of symmetry, which each proceed at an angle of 60° relative to one another, so that three adjacent inductors 10 are arranged in an equiangular triangle in each instance. In the cooktop shown in FIG. 2, three cooking pots 12, 13, 14 are arranged in different positions. The cooking pots 12, 13, 14 have circular bottoms with an identical diameter. A group of inductors 10 is assigned to each of the cooking pots 12, 13, 14, said group of inductors 10 forming a heating zone 16, 18, 20.

The control unit 22 of the cooktop then assigns an inductor 10 to a specific cooking pot 12, 13, 14 if the relevant inductor 10 is covered by the bottom of the relevant cooking pot 12, 13, 14 by more than half. As apparent in FIG. 2, in the case of the cooking pot 12, this applies to seven inductors, while, in the case of cooking pots 13 and 14, six and/or eight inductors 10 are covered by the corresponding cooking pot 13, 14 by more than 50%. Since the cooking pots 12-14 have precisely the same diameter, FIG. 2 clearly shows that the number of inductors, which are assigned to the heating zone 16, 18, 20 of a cooking pot 12, 13, 14, is not only dependent on the size of the cooking pot 12, 13, 14, but also instead on its position.

The control unit 22 uses the inductors 10 to detect the cooking pots 12, 13, 14 so that the inductors 10 form a detection assembly 26 together with the control unit 22. In order to detect the cooking pots 12, 13, 14, the control unit 22 connects the inductors 10 to suitable capacitors to form an oscillating circuit and generates an oscillating current by introducing a voltage impulse. The control unit 22 calculates an attenuation constant from a decaying of this current. The larger the attenuation constant, the greater a degree of coverage between the relevant inductor 10 and the cooking pot 12, 13, 14. In alternative embodiments of the invention, other measuring methods can also be used and/or separate sensors can be deployed.

In order also to achieve an identical total heat output for all three cooking pots 12, 13, 14 in the situation shown in FIG. 2, the control unit 22 not only determines the number of inductors 10 combined into the respective heating zone 16, 18, 20 by means of a suitable algorithm, but instead also determines the bottom surface of the cooking pots 12, 13, 14 with an accuracy which is greater than the accuracy which can be achieved by counting the inductors 10.

The heat outputs of the heating zones 16, 18, 20 are determined by the control unit 22 as a product of the bottom surface of the corresponding cooking pot 12, 13, 14, a maximum surface heat output and a factor between 0 and 1, which is dependent on the power level set by way of the user interface. The value of this factor which depends on the power level is read out from a table by the control unit 22, said table being stored in a storage unit (not shown) of the control unit 22. The following values for the factor which is dependent on the power level have proven advantageous:

| Power level | Factor |
|---|---|
| 0 | 0.0 |
| 1 | 0.031 |
| 1.5 | 0.047 |
| 2 | 0.063 |
| 2.5 | 0.078 |
| 3 | 0.109 |
| 3.5 | 0.125 |
| 4 | 0.156 |
| 4.5 | 0.188 |
| 5 | 0.219 |
| 5.5 | 0.250 |
| 6 | 0.297 |
| 6.5 | 0.359 |
| 7 | 0.438 |
| 7.5 | 0.531 |
| 8 | 0.641 |
| 8.5 | 0.797 |
| 9 | 1.0 |
| B | 1.5 |

The power level B stands for "booster" and describes a mode of operation in which the heating elements can be briefly operated with a heat output which exceeds its nominal output. In addition, a number of inverters and/or output final stages can be used in parallel to operate the inductors 10.

Figure 3:
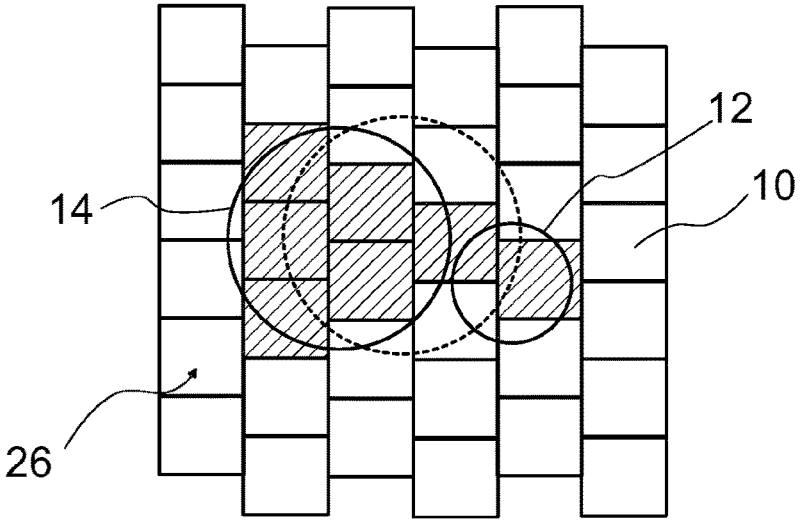
FIG. 3 shows a schematic representation of a measuring point grid for a cooktop having two closely adjacent cooking pots.

FIG. 3 shows a schematic representation of a situation, in which two cooking pots 12, 14 were placed very close to one another on the cooktop. The inductors 10 are shown as small square boxes and the inductors 10 which are covered by one or two of the cooking pots 12, 13 by more than 50% are shown hatched.

Figure 4:
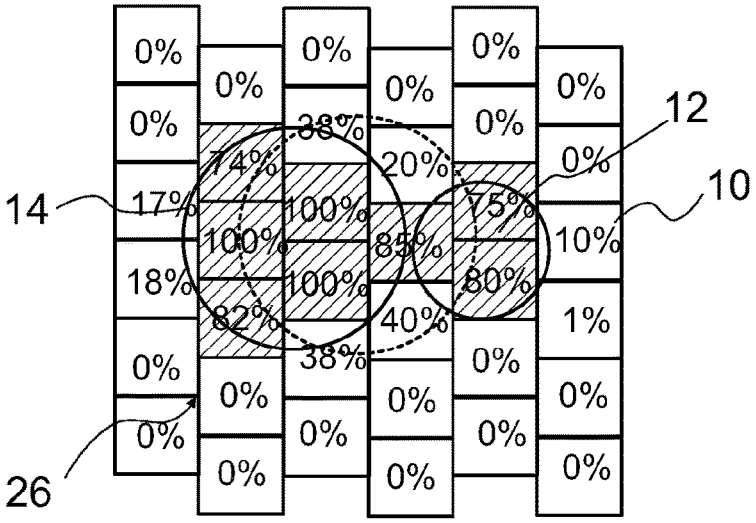
FIG. 4 shows a schematic representation of a measuring point grid for two closely adjacent cooking pots with measurands specified in each instance.

FIG. 4 shows the situation from FIG. 3 (and/or a similar situation), with a percentage being assigned to each of the inductors 10, said percentage forming a measurand and describing a degree of coverage of the relevant inductor 10 by the bottom of one of the cooking pots 12, 14. The inductors 10 which are covered by a cooking top 12, 14 by more than 50% are shown hatched. It is clearly difficult to read off from the hatched area as to whether the cookware element placed on the cooktop is a single pot (possibly a roasting tin) or two pots. Simple algorithms which would determine an area focal point of the area shown hatched in FIG. 4 and calculate a radius of the heating zone as a function of a total area of the hatched area, arrive at an obvious unsatisfactory conclusion of a single round heating zone, which is shown as a dotted circle in FIG. 4. A distinction made between the two cooking pots 12, 14 would also not allow for a simple summation of the degrees of coverage. A heating zone depicted by the dotted circle would not adequately heat any of the cooking pots 12, 13 and would also not enable an independent power output control of the two cooking pots 12, 14.

In accordance with the invention, the measurands determined by the detection assembly 26 will therefore use a sample recognition algorithm known from the image processing. The control unit 22 can determine an edge image of a combined area of pixels with the aid of this sample recognition algorithm, with it being possible for edge detection methods which are known per se to be used. The edge image is used so as to characterize the shape of the bottom surface more precisely and/or to determine the number of pots 12, 13 which are placed on the surface. It is therefore possible in particular to make a distinction between the situation with two pots 12, 14 and a situation with a longish pot.

Figure 5:
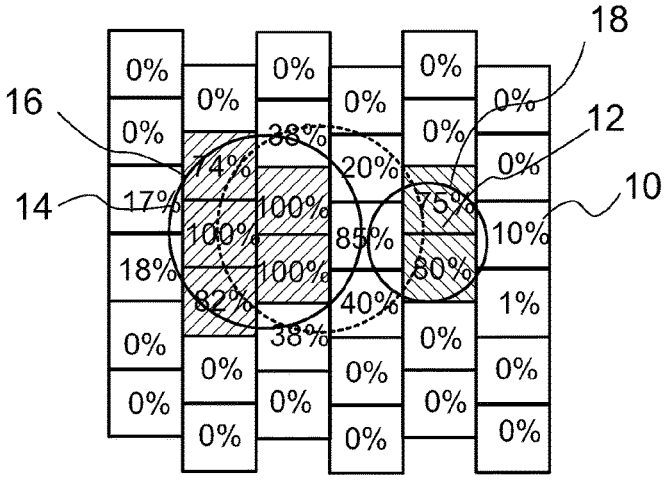
FIG. 5 shows a schematic representation for assigning heating elements to the different cooking pots in the situation shown in FIG. 4.

The use of the sample recognition algorithm or another suitable separation algorithm (which can originate for instance from the recognition of symmetries), enables the pots 12, 14 to be separated from one another and the control unit 22 can, as shown in FIG. 5, assign a heating zone 16, 18 to each of the cooking pots 12, 14. After separating the cooking pots 12, 14, the bottom surface of the cooking pots 12, 14 can likewise be easily determined, for instance as the area of the circle shown in FIG. 5.

Different groups of inductors 10 are then assigned by the control unit 22 to the heating zones 16, 18 thus defined in each instance, said groups of inductors generating the heat output of the respective heating zones 16, 18. This assignment is shown in FIG. 5, inductors 10, which are overlapped by both heating zones 16, 18, remain inactive here. The control unit 22 determines a heat output for each of the heating zones 16, 18 in the afore-described fashion, and operates the inductors 10 assigned to the corresponding heating zones 16, 18 such that a specific total heat output is generated overall. This total heat output is calculated in the afore-described fashion by the control unit 22 for each active heating zone 16, 18 as a function of the bottom surface of the cooking pots 12, 14 and as a function of the power level set for the respective heating zone 16,18. In order to determine the bottom surface, the control unit 22 assigns one of the categories "round", "oval", "rectangular" to the detected cooking pot 12, 14, and determines the parameters of the respective geometric shape in an optimization method such that the covered area is described best. In the case of round pots, the control unit determines the radius and calculates the bottom surface from the radius.

In one possible embodiment of the invention, when determining the total heat output, the maximum surface heat output can be determined as a function of the bottom surface of the cookware element to be heated. In a particularly advantageous embodiment of the invention, the maximum surface heat output is a monotonic decreasing function of the bottom surface.

Figure 6:
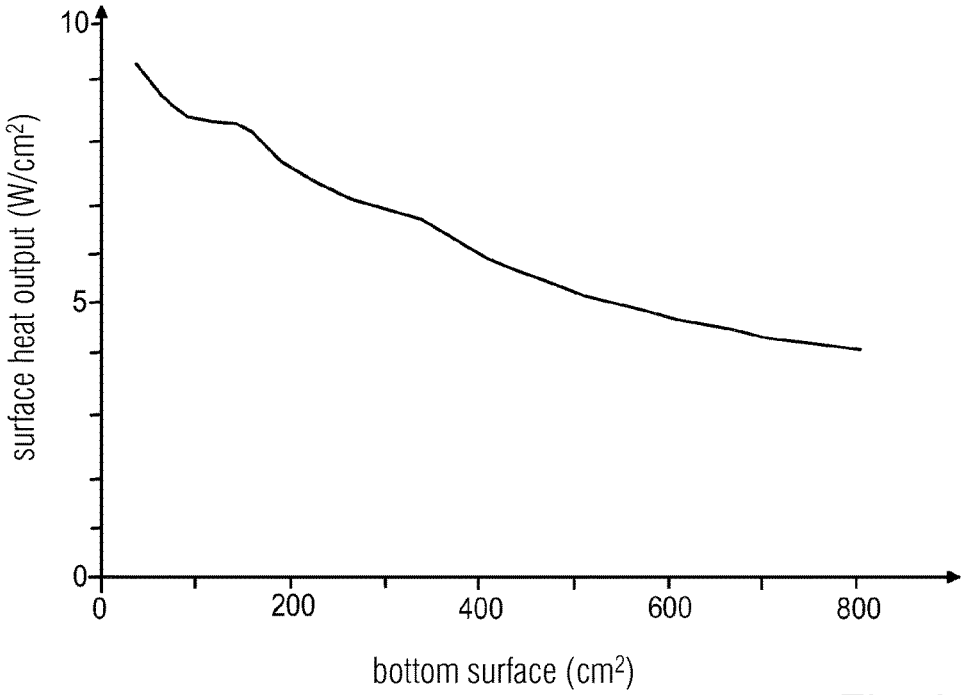
FIG. 6 shows a schematic representation of the dependency of a surface heat output on the bottom surface of a cookware element.

FIG. 6 shows a possible selection of the dependency of the maximum surface heat output of the bottom surface. Small waves in the course of the graph in FIG. 6 can take account of the strength of the effect shown in FIG. 2. In particular, in the range of small pot sizes, certain pot sizes can be better adjusted to the grid of the inductors 10 than others.

LIST OF REFERENCE CHARACTERS

10 Inductors
12 Cooking pot
13 Cooking pot
14 Cooking pot
16 Heating zone
18 Heating zone
20 Heating zone
22 Control unit
24 User interface
26 Detection assembly

The invention claimed is:

1. A cooktop, comprising:
a plurality of heating elements;
a detection assembly which detects a measurand of a cookware element; and
a control unit which combines a number of the plurality of heating elements into a heating zone as a function of the detected measurand, operates the heating elements of the heating zone with a total surface heat output, calculates a surface area of a bottom surface of the cookware element based on the detected measurand, and determines the total surface heat output from the heating elements in the heating zone and which is to be received by the cookware element as a function of a power level input at a user interface and the calculated surface area of the bottom surface.

2. The cooktop of claim 1, wherein the control unit determines the surface area of the bottom surface of the cookware element at least partially independently of a number of the plurality of heating elements of the heating zone assigned to the cookware element.

3. The cooktop of claim 1, wherein the heating elements comprise inductors.

4. The cooktop of claim 3, wherein said detection assembly is operably connected to the inductors to inductively detect the cookware element.

5. The cooktop of claim 1, wherein:
each measurand is assigned to a measuring point on a cooktop surface; and
the measuring point from each measurand forms a measuring point grid.

6. The cooktop of claim 5, wherein the control unit determines the surface area of the bottom surface of the cookware element with an accuracy which is greater than an accuracy achievable by counting the measuring points which are covered by the bottom surface of the cookware element.

7. The cooktop of claim 5, wherein each of the measuring points corresponds to a center point of one of the heating elements.

8. The cooktop of claim 1, wherein the control unit determines the total surface heat output from the heating elements in the heating zone and which is to be received by the cookware element by multiplying the calculated surface area of the bottom surface of the cookware element with a maximum surface heat output by the heating elements and with a numerical factor which depends on the power level input at the user interface.

9. The cooktop of claim 8, wherein the total surface heat output from the heating elements in the heating zone and which is to be received by the cookware element is a monotonic decreasing function of the surface area of the bottom surface of the cookware element.

10. The cooktop of claim 1, wherein the measurand comprises a position of the cookware element on the cooktop.

11. The cooktop of claim 1, wherein the control unit calculates the surface area of the bottom surface of the cookware element by:
assigning a geometric shape to the detected cookware element; and
determining parameters of the assigned geometric shape.

12. A method for operating a cooktop, comprising:
detecting a measurand of a cookware element;
combining a number of heating elements to form a heating zone as a function of the detected measurand;
calculating a surface area of a bottom surface of the cookware element from the measurand;
determining a total heat output from the heating elements in the heating zone and which is to be received by the cookware element in the heating zone as a function of a power level input by a user and the calculated surface area of the bottom surface of the cookware element; and
operating the heating elements of the heating zone using the determined total heat output.

13. The method of claim 12, wherein the measurand comprises a position of the cookware element on the cooktop.

14. The method of claim 12, wherein calculating the surface area of the bottom surface of the cookware element comprises:
assigning a geometric shape to the detected cookware element; and
determining parameters of the assigned geometric shape.

15. A method for operating a cooktop, comprising:
combining a number of heating elements to form a heating zone as a function of a detected measurand of a cookware element;
calculating a surface area of a bottom surface of the cookware element by assigning a geometric shape to the cookware element and determining parameters of the assigned geometric shape;
determining a total surface heat output from the heating elements in the heating zone and which is to be received by the cookware element as a function of an input power level and the calculated surface area of the bottom surface; and
operating the heating elements of the heating zone using the determined total surface heat output from the heating elements in the heating zone and to be received by the cookware element.

16. The method of claim 15, wherein the measurand comprises a position of the cookware on the cooktop.

* * * * *